US006250798B1

(12) United States Patent
Brainard et al.

(10) Patent No.: US 6,250,798 B1
(45) Date of Patent: Jun. 26, 2001

(54) SOLAR CRYSTAL MOTION DEVICE

(76) Inventors: John Paul Brainard; Hertha Ann Brainard; Nicolas Charles Brainard, all of 1419 White Rim Pl., NE., Albuquerque, NM (US) 87112

( * ) Notice: Subject to any disclaimer, the term of this patent is extended or adjusted under 35 U.S.C. 154(b) by 0 days.

(21) Appl. No.: 09/158,359

(22) Filed: Sep. 21, 1998

(51) Int. Cl.[7] ..... G04B 17/02
(52) U.S. Cl. ..... 368/180; 368/134; 368/327
(58) Field of Search ..... 368/134–136, 368/165, 166

(56) References Cited

U.S. PATENT DOCUMENTS

| | | | | |
|---|---|---|---|---|
| 12,196 | * | 1/1855 | Crane | 368/180 |
| 2,292,139 | * | 8/1942 | Ioew | 368/135 |
| 2,625,787 | * | 1/1953 | Reiner | 368/166 |
| 4,421,421 | * | 12/1983 | Bradt | 368/229 |
| 5,232,105 | * | 8/1993 | Gregg | 211/113 |

FOREIGN PATENT DOCUMENTS

| | | | | |
|---|---|---|---|---|
| 1052319 | * | 3/1959 | (DE) | 368/134 |
| 2093230 | * | 8/1982 | (GB) | 368/165 |
| 0050679 | * | 3/1987 | (JP) | 368/179 |

* cited by examiner

*Primary Examiner*—Bernard Roskoski

(57) ABSTRACT

This device projects slow moving light beams on the shadowed regions of a windowed room when the sun shines through the window. It includes a crystal-set (9) directly suspended from the bottom of a vertical rotor (14) of a motor (2) by a thread-like member (12). A small box (1), with attachment means to the window, supports the following interconnected electrical components: the motor (2) discussed above, a solar panel array (5), a capacitor (4), and a circuit (3). The capacitor is repeatedly charged slowly when the solar panel is exposed to sunlight, and discharged quickly by the circuit through the motor windings to occasionally pulse rotate the motor rotor about one turn. This occasional quick rotation activates and sustains the smooth and slow meandering rotation of the crystal-set about a vertical axis because of the loose thread-like member coupling between the motor rotor and crystal-set. The refracted and reflected light beams from the sunlit crystal-set produces a beautiful and entertaining light display of moving light beams that ebb and flow over the shaded surfaces of a sunlit room.

6 Claims, 3 Drawing Sheets

SOLAR CRYSTAL MOTION DEVICE

BACKGROUND OF THE INVENTION

1. Field of Invention

This invention relates to toys, displays, or music boxes that are activated by light and ago are driven by an electric motor powered by solar panels and/or small batteries.

2. Prior Art

It is a very pleasant experience to watch sunlit, colored, and/or rainbow beams of light projected on the walls of a room when sunlight is refracted and reflected by cut crystals. For a greater effect, we have tried to slowly move crystals when they are exposed to sunlight so that the light beams also move throughout the room and the crystals sparkle. The desired motion is a slow oscillation that rotates the crystals between a clockwise and counter-clockwise (or vice versa) motion. We have tried Christmas ornament motors driven by 60 Hz AC power where the power was reduced to low voltage by a transformer or a voltage divider. We have obtained low voltage DC motors that are highly geared down (found in motor driven dolls) and operated them with solar panels or batteries. We have tried various clockworks which use crystal oscillators for timing circuits. We have tried flexible metal motor shafts to transport the rotation from the relatively large motor gear assembly to the crystal. Finally we have tried bi-metalic devices which move when heated by the sun. These ideas have driven the cost above what we think the market will bear, and they are larger than necessary in our judgement.

In order to reduce cost and size of the device, we have come up with the present design which uses none of the above methods. Also we have achieved the more desirable slow, smooth oscillating rotations that are much more interesting than a steady state rotation because the beams of light stop periodically for a clear vision of the beam patterns. In our invention, we are pulse rotating a motor to minimize the size of the motor, power supply and we are using these pulses to excite the natural frequency of a rotational pendulum (a crystal suspended by a thread) such that the crystal rotates in a smooth oscillating manner. The motor, power supply is energized by a small solar panel or a small, light-activated battery.

To drive the motor, we are using a method common to electrical engineers to produce high current pulses from low DC current supplies. An example of this method is found in the automobile where a capacitor is charged by a low current and then discharged at high current through the primary windings of a transformer coil so that sufficient voltage is generated on the secondary winding to create an arc across the gap of a spark plug.

With a variable charging current (especially from the solar panel), a timing circuit used to trigger the discharge of the capacitor such as those found in U.S. Pat. No. 5,760,572 of Takeda and Fujii would, for the most part, discharge the capacitor either too early or too late. When too early, before the capacitor is charged, there is not enough energy to rotate the motor, or when too late, long after the capacitor is charged, the charging time for the next pulse is lost. The chance of a timed discharge to occur exactly at the time the capacitor just charges is very low. By always discharging the capacitor just as the capacitor is charged, as we do, we maximize the efficiency of rotation and hence minimize the size of the solar panel or battery.

It should be noted that we are not trying to move an object from point A to point B or to store energy for use hours later such as found in U.S. Pat. No. 5,760,572 of Takeda and Fujii and U.S. Pat. No. 4,901,295 of Daho Taguezout and Xuan respectively. We are simply maintaining, more or less, the continuous rotation of a crystal. The motion of the crystal, of course, depends on the motor pulse rate (depending on the solar intensity or the age of the battery) and the natural frequency of the rotational pendulum which depends on the thread length and stiffness, and the moment of inertia of the crystal which is suspended by the thread. We are not using geared down motors to turn crystals slowly and continuously such as found in U.S. Pat. No. 5,232,105 of Gregg.

SUMMARY OF THE INVENTION

One objective of this invention is to use a means, such as a crystal, to breakup some of the sunlight that is coming through a window into moving light beams that are projected onto the non-sunlit surfaces of a room for a beautiful light display that is very pleasing to to the observer. Another objective is to slowly move the crystal-like means in an oscillating manner so that the light beams periodically stop so that the beam pattern can be clearly observed. Finally we would like to minimize the cost and size of the solar crystal motion device. We are accomplishing all of these objectives by rotating crystals, which are mounted in a window, in a unique way. In its simplest form, a crystal-set (for example one or more crystals like those used in crystal chandeliers) is suspended from a point by a thread-like member (a silk thread for example) and is rotated around the vertical axis of the thread-like member by means of a motor when sunlight strikes the crystal-set and a solar panel (or a solar switch in the case of a battery). The motor rotates the crystal-set by occasionally pulse rotating the top of the thread-like member near its support point which in turn rotates the crystals. We will define in more detail what we mean by crystal-set, crystal, and thread-like member in the detailed description section.

We are pulse rotating the motor shaft by using the method well known to the electrical engineer of slowly charging a capacitor with a relatively low current DC supply (by means of a battery or a solar panel) and discharging the charged capacitor through the motor windings in a relatively short time to obtain much higher currents; that is, a pulse of relatively high current through the motor windings sufficient to rotate the motor about one rotation. The cycle is then repeated as fast as it takes for the capacitor to recharge. If we were to run the motor continuously, we would need a bulky gear set to reduce the shaft speed and a much larger solar panel or battery to supply the necessary DC current. The size and cost of such a device would be substantially greater and we would not have the desired oscillating effect.

While the thread-like member at its top end is pulsed rotated (about one quick turn every half minute on average) around it's vertical axis, the crystal-set at the bottom end moves smoothly in an oscillating manner between clockwise and counter-clockwise (or vice versa) motion due to the loose coupling through the thread-like member. We could, of course, electronically switch the motor winding leads to reverse the motor shaft rotation after every one or more current pulses, but it would require more circuitry. The crystal-set oscillates very nicely without this complication if attention is given to the mechanical properties of the rotational pendulum (the crystal-set suspended by the thread-like member).

The crystal-set initially rotates in the same direction as the top end of the thread-like member, but by the time of the next rotational pulse, the crystal-set has reversed its direction (or at least stopped) due to the relaxation of the twist in the thread-like member and the moment of inertia of the crystal-set. When the solar intensity is low or as the battery ages, the capacitor takes longer to charge and the pulse rate is reduced. Even so, the crystal motion is still effective.

In the case where a battery is the primary current source there is a photo switch that turns on with exposure to sunlight and allows a low current (limited by a resistor) to flow from the battery into the same circuit used for the case of the solar panel discussed above. Of course, the battery could be used with a solar panel array to help reduce the current drain of the battery and increase the lifetime of the battery.

DETAILED DESCRIPTION

The present invention is a small, simple, and low cost device which comprises at least one slowly rotating crystal-set (for example one or more crystals like those found in a crystal chandelier) in a sunlit window. The crystal-set slowly and smoothly rotates in an oscillating manner such that a room can be filled with moving sunlit, colored, and/or rainbow beams of light (which periodically stop) and the crystal-set sparkles.

The crystal-set is suspended by a thread-like member (a silk thread for example), a motor pulse rotates the top of the thread-like member, and the crystal-set slowly oscillates at the bottom of the thread-like member —all rotations occur about a common vertical axis. We will define a pendulum-set as a crystal-set suspended by a thread-like member from a point such that when the thread-like member is suddenly twisted one or more turns near its support point, the crystal-set will rotate for a time back and forth—all of these rotations share the same vertical axis. At least two vertical pendulum-sets can be attached (one on top of the other in a daisy chain fashion) to create more interesting motions because the pendulum-sets play off of each other. In this case, the top of the thread-like member at the lower pendulum-set is attached at the crystal-set of the upper pendulum-set along the same axis of rotation; some of the crystals could be replaced by weights to retain the interesting motion and decrease the cost of multiple crystals.

The motor rotor or motor shaft can be directly attached to the vertical thread-like member when the motor shaft is vertical and in line with the thread-like member; or the motor shaft can be indirectly attached to the vertical thread-like member by a means such as a pulley/belt or a gear arrangement. In this latter case, two or more pendulum-sets which do not share the same vertical axis (the axes are parallel, but are displaced at some perpendicular distance from each other) could be rotated by one motor.

Figure 1A:
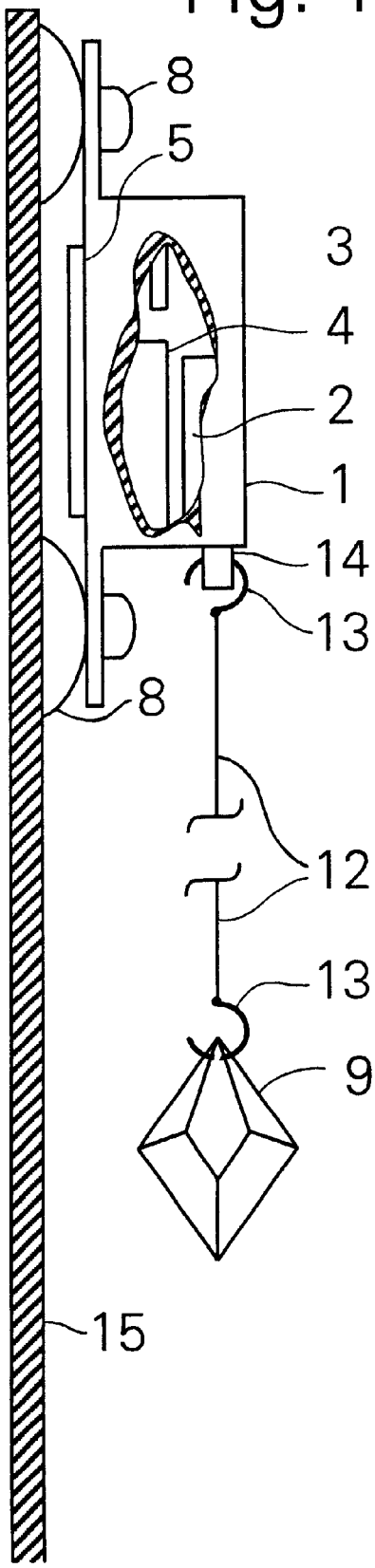
FIG. 1A is the preferred embodiment of this invention powered by a small solar panel array showing the layout of the major components and the suction cup mounting on a windowpane.

FIG. 1A shows the preferred embodiment. A rectangular box 1 container (plastic or metal for example) is about ½inch wide (when looking out through the window) approximately ¾inch deep and about 3 inches in height. This container of course can be made in a variety of shapes with about the same volume; for example, a cylindrical tube. These dimensions permit a small, inexpensive DC motor 2, a small circuit 3, and a large value capacitor 4 (about 1000 microfarads) to be enclosed by the box 1. A small solar panel array 5 (about 1 mA capacity) is mounted on the external side of box 1 that faces the windowpane 15. When the solar panel array 5 is exposed to light, the motor rotor or motor shaft 14 of motor 2 is occasionally pulsed rotated. The more or less vertical thread-like member 12 with the hooks 13 is attached at its top to the motor shaft 14 and at its bottom to the crystal-set 9; all share the same axis of rotation. This permits the crystal-set 9 to be suspended from the bottom of the pulsed vertical shaft 14 of the motor 2 and allows the crystal-set 9 to rotate clockwise and counter clockwise (or vice versa) in a smooth oscillating manner. The box 1 is essentially a pendulum-set hanger with a miniature built-in motor and power supply to move the pendulum-set. Certainly other pendulum-sets can be daisy chained onto the first in order to obtain a more interesting light display.

Two suction cups 8 are mounted on the window side of the box 1 and are used to support the box 1 with its internal components, the solar panel array 5, the crystal-set 9, the hooks 13, and the thread-like member 12 from the windowpane 15 by fastening the suction cups 8 to the windowpane 15; of course one (or more suction cups or other means such as glue or tape) could be used. The solar crystal motion device could also be hung from the window frame or sill by some means such as a bracket or a stand. The device, as well, can be supported on or near a man-made light source (lamp or chandelier for example) by a means such that the man-made light source activates the device and the crystal-set 9 will turn. The man-made light source must be brighter than the ambient light of a room in order to observe the light display: hence forward we will refer to this light source as a bright man-made light source. A laser beam, an example of a bright man-made light, could be projected on to the crystal-set 9 to enhance the light show in the room. We will also define bright light to include either or both sunlight and bright man-made light. In these cases suction cups 8 may not be used. The box 1 does tend to twist in the opposite direction of the motor shaft 14 if the box 1 is not rigidly mounted. This twisting motion could be useful in randomly moving the crystal 9, but we think it is distracting. The motor housing could be more or less free to rotate within box 1 to reduce the torque produced by the motor shaft 14. In our case with the suction cup mount, however, there is no observed twisting motion.

With the above dimensions, the maximum diameter of the crystal-set 9 can be nearly two inches before the window interferes with the motion. For a larger crystal-set 9, the rectangular box 1, of course, could be made deeper to further remove the motor shaft 14 from the windowpane 15, or the suction cups 8 could be extended further away from box 1 and motor shaft 14 with appropriate brackets. However, the weight of the crystal-set 9 should be limited because the motor bearings will have too much friction from the weight and the motor shaft 14 will move too slowly. On the other hand, if the crystal-set 9 is too light in weight, the crystal-set 9 may not have enough moment of inertia to smooth out the pulsing motor shaft 14; this also can happen when the thread-like member 12 is too stiff.

Figure 1B:
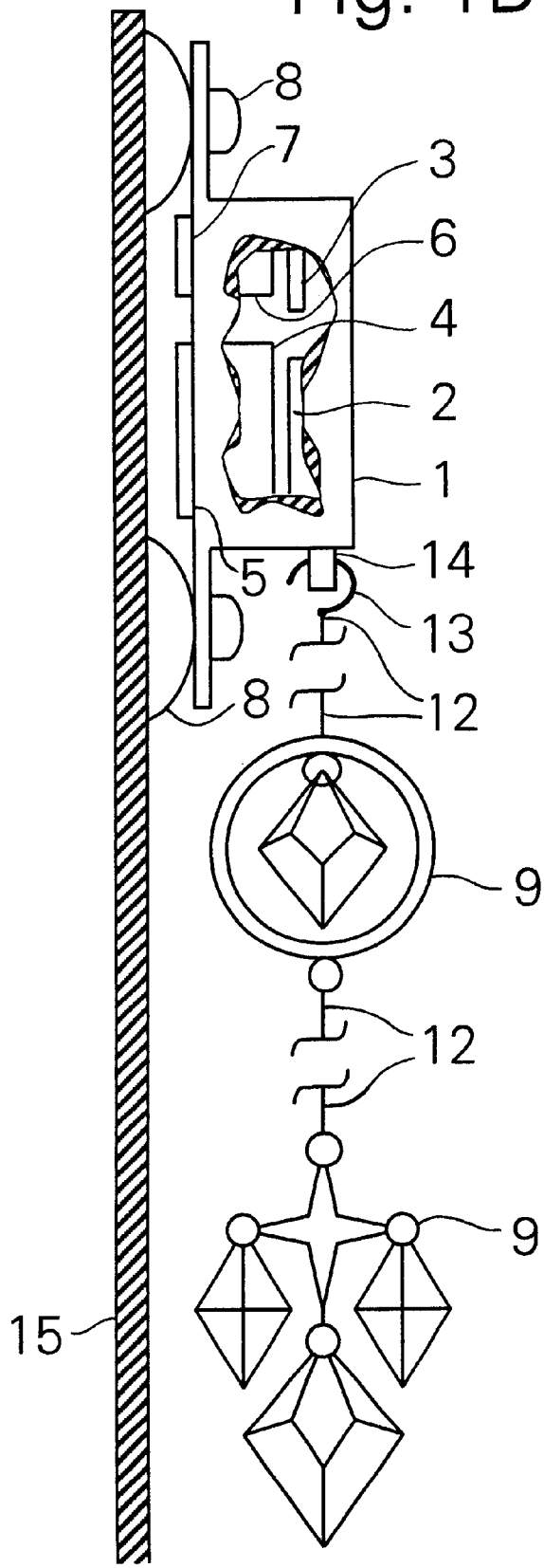
FIG. 1B is an alternate embodiment using a battery as the power source with or without a solar panel used to reduce the current drain of the battery. Also shown is an example of attaching two pendulum-sets together on the same axis of rotation.

FIG. 1B shows an alternative embodiment where a battery 6 is the main source of power. A photoswitch 7 (mounted on the window side of the box 1) is used to turn on the battery current when the photoswitch 7 is exposed to light. What we mean by a photoswitch 7 is any electronic device which is at high impedance in the absence of light, and low impedance when exposed to light. A small solar panel 5 on the window side of the box 1 can be used with the battery 6 to help reduce the current drain of the battery 6. In this case no diode is needed to prevent the battery 6 from leaking current through the solar panel array 5 because the photoswitch 7 prevents this from occurring. Also in FIG. 1B is shown an example of how more than one crystal-set 9 and more than one thread-like member 12 can be attached to the motor shaft 14; of course, some of the crystals may be replaced by weights to lower the additive cost of the crystals, but retain the interesting and entertaining motions of the remaining crystals.

Figure 2A:
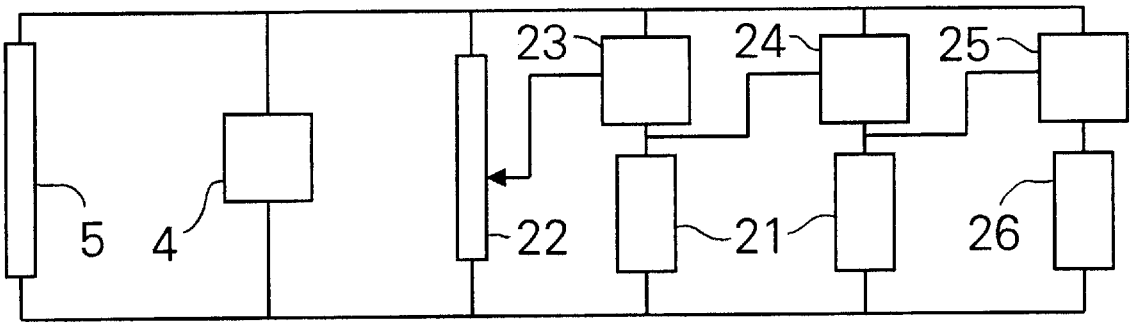
FIG. 2A shows the electrical schematic of the circuit used to pulse rotate the motor using a solar panel array as the power source. The electrical components (which are well known) are represented by boxes.

FIG. 2A shows the circuit diagram for the case where a solar panel supplies all the power. A low current (about one mA) at the small solar panel array 5 comes in from the left and charges the capacitor 4 (about 1000 microfarads). A high impedance voltage divider 22 (about 100,000 ohms or greater) divides the capacitor voltage down so that the capacitor voltage can be compared to a reference voltage (about 2.5 volts) of the comparator 23. When the capacitor 4 is nearly charged at a few volts, the divided voltage matches the reference voltage and the comparator 23 triggers a transistor 24 which triggers the silicon controlled rectifier 25 that allows the capacitor 4 to be discharged through the coils 26 of the motor 2. The circuit resets itself when the capacitor falls to a low level after the discharge. The motor 2 pulse rotates the shaft 14 about one turn every half minute. Timing between pulses is determined by the capacitance of the capacitor 4 and the current from the small solar panel array 5. Resistors 21 (about 50,000 ohms) are used to help generate the proper trigger signals. We expect, as technology improves, a smaller circuit with the same function will be possible.

Figure 2B:
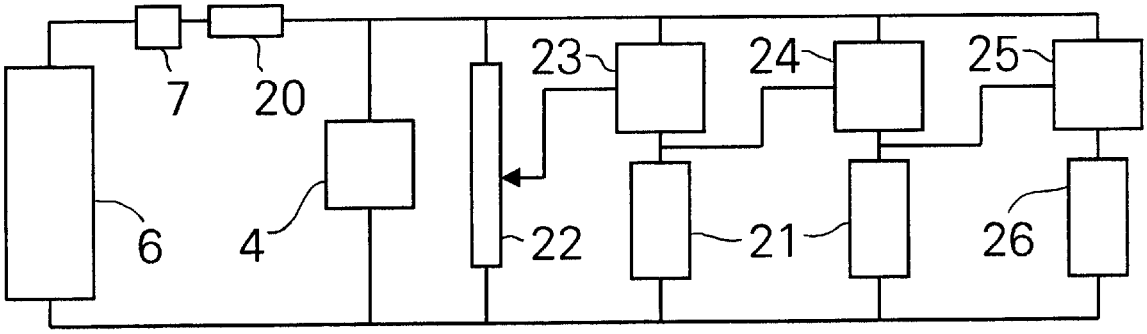
FIG. 2B shows the circuit diagram for the case where a small battery supplies all of the power. The well known electrical components are represented by boxes.

FIG. 2B shows the circuit diagram for another means of light-activated current source. In this case a small battery 6 (a few volts) supplies all of the power. Here a current limiting resistor 20 is needed (a few thousand ohms) to limit the battery 6 current in order to reduce the current drain of the battery 6 and to maintain the slow pulse rate of the motor shaft 14. A photoswitch 7 is needed to activate the motor 2 and limit the power drain to the period of time that the device is exposed to light. All other component values are the same as that of FIG. 2A.

Figure 2C:
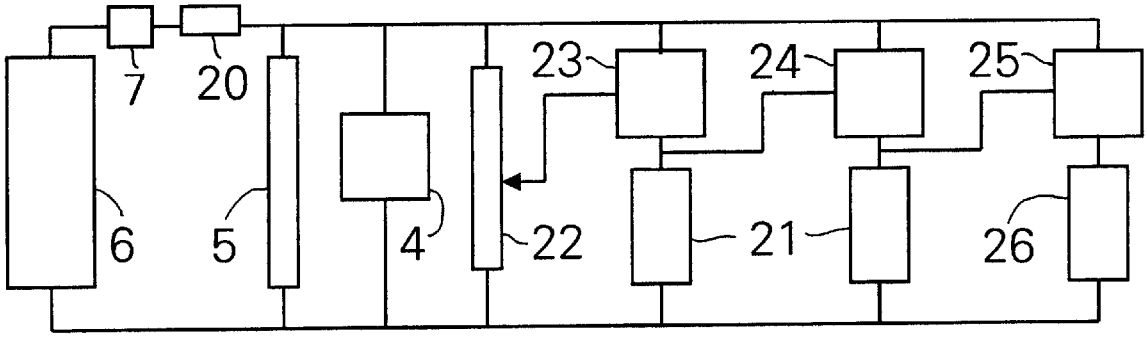
FIG. 2C shows the circuit diagram for the case where a small solar panel array is used along with the battery to reduce the current drain of the battery. The well known electrical components are represented by boxes.

FIG. 2C shows the circuit diagram for the case where a small solar panel array 5 (about half a mA) is used with a battery 6 to further reduce the current drain of the battery 6. By placing the solar panel array 5 in the location shown, no diode is required to prevent the battery 6 from leaking current through the solar panel array 5. All the other components have the same values as that of FIG. 2B.

Figure 3A:
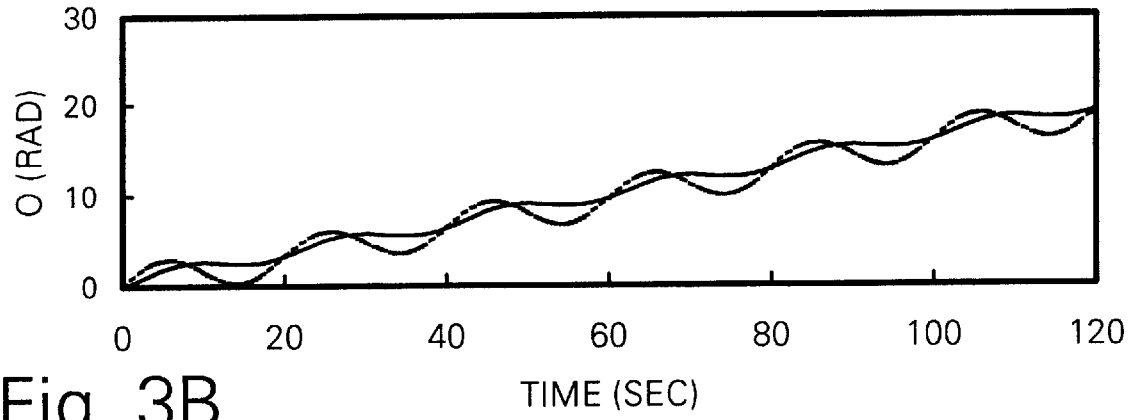
FIG. 3A shows some typical motions of a crystal-set in response to pulsed rotations at the top of the thread-like member. $\theta$ is the rotational angle of the crystal around the vertical axis of rotation and is shown as a function of time.
Figure 3B:
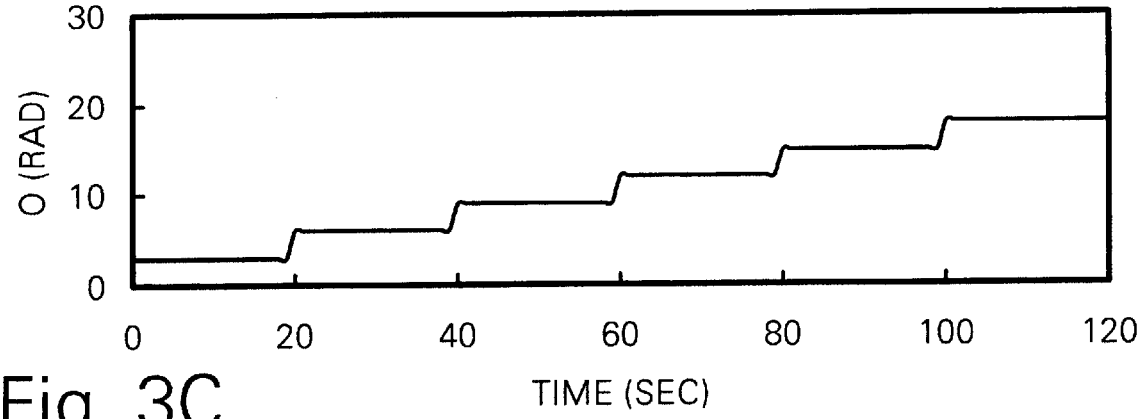
FIG. 3B shows an example of a train of pulsed rotations at the top of the thread-like member. $\phi$ is the rotational angle of the top of the thread-like member and is shown as a function of time.

FIG. 3A shows examples of what we mean when we say the crystal-set 9 slowly and smoothly rotates in an oscillating manner. The angle of rotation of crystal-set 9 about the vertical axis is plotted as a function of time. The crystal-set 9 initially rotates in the direction of the pulsed rotation at the top of the thread-like member; but by the time of the next pulse, the crystal-set 9 is rotating in the opposite direction due to the relaxation of the twist in the thread-like member 12. The curves in FIG. 3A show different responses to different physical properties of the pendulum-set for a given pulse rotation rate. These curves are solutions to the equation of motion (somewhat over simplified) of the crystal-set 9:

$$I\ddot{\theta}+f\dot{\theta}+k(\theta-\phi)=0$$

where I is the total moment of inertia of the crystal-set 9 around the vertical axis of rotation, θ is the angle of rotation of the crystal-set 9 around the vertical axis, f is the friction loss, k is the torque required to rotate the thread-like member 12 per unit angle, and ϕ is the stepped rotation at the top of the thread-like member 12 shown in FIG. 3B. The thread-like member 12 is twisted by the rotation difference between the crystal-set 9 at the bottom and the pulse rotation at the top. The natural cycle time period of this system is $2\pi\sqrt{I/K}$, and as long as this time period is less than or about equal to the time between rotation pulses of the motor shaft 14, the crystal-set will oscillate. In FIG. 3A the dashed curve with the greater amplitude of oscillations represents a pendulum-set with a shorter cycle time than the flatter curve (solid line). We can see that the crystal-set at the bottom of the thread-like member is free to move in a smooth meandering manner.

Figure 3C:
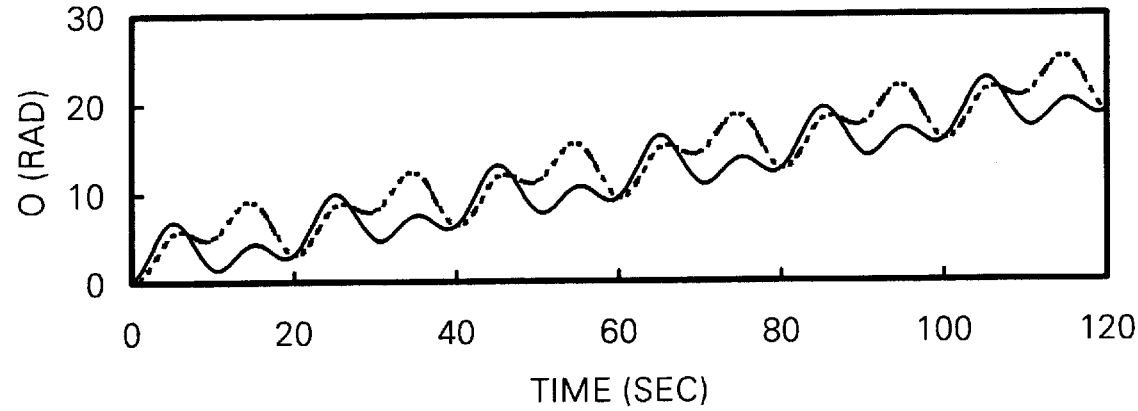
FIG. 3C shows the interesting angular rotations (as a function of time) that can occur when two pendulum-sets are suspended from each other on the same axis of rotation.

In FIG. 3B we see an example of pulsed angular rotations at the top of the thread-like member produced by the motor shaft 14 for the crystal rotations shown in FIG.3A and FIG.3C. In other words, the top of the thread-like member rotates in a step-like manner. ϕ is the angle of rotation and is shown as a function of time.

FIG. 3B shows a realistic example of a series of steps where each step occurs in a time much less than a second (~0.01 seconds) separated by a 20-second rest period. Because the motor is tuned off most of the time (greater than 99% of the time), we have very low energy consumption.

FIG. 3C shows the interesting rotational response by the pulsed rotation (shown in FIG. 3B) of two pendulum-sets, one hanging from the other. as shown in FIG. 1B. The dashed curve represents the top crystal-set 9 motion and the solid curve represents the bottom crystal-set 9 motion. In this case, the upper pendulum-set has a shorter cycle time than the bottom pendulum-set.

We would now like to define in more detail what we mean by crystal-set 9, crystal, thread-like member 12, and solar panel array 5. The crystal-set 9 is a structure that comprises one or more crystals such that the crystals remain in more or less fixed position with respect to each other. This structure should be rotationally balanced to prevent wobbling as it rotates with the thread-like member 12. Counter weights can be used to accomplish this. Typically there would be a means of attaching the thread-like member 12 to the structure on the axis of rotation. By crystal we mean a generally transparent (clear or colored) object that is more or less faceted, and can refract, defract, filter, defuse, disperse, and/or reflect light. At least one facet may be mirrored or semi-mirrored. The crystal-set 9 may be opaque if the surfaces are mirrored. Clear, colored, or patterned thin films may be placed on the facet surface to produce, or help produce colored light from the sun or from man made light sources. The crystal may have one or more holes through it for either attaching it to the crystal-set 9 or directly attaching to the thread-like member 12. The holes may also be present to produce more interesting light patterns. If a crystal has no hole, a wire frame (or setting) can be used to attach it to the crystal-set 9 or directly to the thread-like member 12 (similar to the attachment of a precious stone in jewelry). The crystal, of course, can be bonded directly to the crystal-set 9 or to the thread-like member 12. Laser light could be projected on to the crystal-set 9 for a more brilliant light display on the walls of a room.

What we mean by thread-like member is any long (on the order of inches), thin flexible structure that is strong enough to suspend a crystal-set 9 from a point and will rotate the crystal-set 9 in an oscillating manner after the structure is suddenly twisted at its support point. The structure could be made of any one or any combination of the following: for example, items like thread, wire, tube, chain, chord, string, cable, et cetera that can be made out of materials like plastic, glass, metal, wood, cloth, paper, synthetic or natural fiber, rubber et cetera. These structures of course can be coated, dyed, painted, treated, et cetera, to color or to modify the mechanical properties. The properties of the thread-like member 12 may vary across its length; for example, the structure may be stiffer at the motor 2 end than the crystal-set 9 end. Some examples of thread-like members 12 are as follows: a single silk thread; two or more strings that are more or less parallel and/or bonded or woven together; a chord that changes in material along its length; a plastic chain; an intricate filigree of fine wire; and a metal wire spiral (or coil) winding. Also objects d'art can be attached to, between, or around the thread-like member 12 and the object d'art itself could be the thread-like member 12 if it were flexible enough.

What we mean by a solar panel array 5 is one or more solar cells and/or solar panels that are electrically connected in series and/or parallel to obtain the desired current and voltage.

It should be appreciated by those skilled in the art, this invention may take on various embodiments other than the illustrative embodiments heretofore described. Accordingly, we intend by the following claims to cover all modifications within the spirit and scope of the invention.

What is claimed is:

1. A device comprising the following:

a. a pendulum-set comprising the following:
   1. a crystal-set suspended by
   2. a thread-like member by attachment means, and b. the following electrically interconnected components:
   1. an electric motor such that its motor rotor is vertical,
   2. a light-activated current source,
   3. a capacitor, and
   4. a circuit;

said pendulum-set is suspended vertically from bottom of said motor rotor by direct attachment means; when said light-activated current source is exposed to bright-light, said capacitor is repeatedly charged by means of said light-activated current source, and discharged through the windings of said electric motor by means of said circuit, to occasionally pulse rotate said motor rotor and the top of the said thread-like member to activate and sustain the rotation of said crystal-set in a smooth meandering manner about a vertical axis; whereby the said crystal-set when exposed to bright light produces a very pleasing and entertaining light display.

2. The device of claim 1 further including a container comprising:

a. an attachment means of support to an external structure, b. an enclosure and support means for said interconnected components, c. a means to allow said light-activated current source to be exposed to bright light, and d. a clearance path means for said motor rotor and said pendulum-set.

3. The device of claim 2 wherein said attachment means of support to an external structure comprises a means of direct attachment to a windowpane.

4. The device of claim 1 wherein said light-activated current source is selected from a group consisting of the following:

a. a solar panel array, b. a battery supply comprising the following electrically series connected parts:
   1. a battery,
   2. a photoswitch, and
   3. a limiting resister; and c. a combination means of both said solar panel array and said battery supply.

5. The device of claim 1 wherein said bright light is selected from a group consisting of sunlight and bright man-made light.

6. The device of claim 1 further including one or more pendulum-sets; suspended one from the other, top to bottom by attachment means with a common vertical axis suspended from the bottom of said pendulum-set of claim 1 by attachment means.

* * * * *